US010626839B2

(12) United States Patent
Andersson et al.

(10) Patent No.: US 10,626,839 B2
(45) Date of Patent: Apr. 21, 2020

(54) IGNITION SYSTEM FOR LIGHT-DUTY COMBUSTION ENGINE

(71) Applicant: Walbro LLC, Tucson, AZ (US)

(72) Inventors: Martin N. Andersson, Caro, MI (US); Cyrus M. Healy, Ubly, MI (US)

(73) Assignee: Walbro LLC, Tucson, AZ (US)

( * ) Notice: Subject to any disclaimer, the term of this patent is extended or adjusted under 35 U.S.C. 154(b) by 0 days.

(21) Appl. No.: 16/045,803

(22) Filed: Jul. 26, 2018

(65) Prior Publication Data

US 2018/0328333 A1 Nov. 15, 2018

Related U.S. Application Data

(63) Continuation of application No. 14/786,256, filed as application No. PCT/US2014/036589 on May 2, 2014, now Pat. No. 10,066,592.

(Continued)

(51) Int. Cl.
*F02P 5/00* (2006.01)
*F02P 3/04* (2006.01)

(Continued)

(52) U.S. Cl.
CPC ..... *F02P 3/04* (2013.01); *F02P 3/0807* (2013.01); *F02P 5/1502* (2013.01); *F02D 2400/06* (2013.01); *F02P 1/086* (2013.01)

(58) Field of Classification Search
CPC ..... F02P 3/04; F02P 3/0807; F02P 5/1502; F02P 9/002; F01P 1/086

(Continued)

(56) References Cited

U.S. PATENT DOCUMENTS 4,051,828 A 10/1977 Topic
4,258,296 A 3/1981 Gerry (Continued)

FOREIGN PATENT DOCUMENTS

CN 101270716 A 9/2008
CN 102174921 A 9/2011

(Continued)

OTHER PUBLICATIONS

Written Opinion & International Search Report for PCT/US2014/036589 dated Sep. 5, 2014, 15 pages.

(Continued)

*Primary Examiner* — Hai H Huynh
*Assistant Examiner* — Gonzalo Laguarda
(74) *Attorney, Agent, or Firm* — Reising Ethington P.C.

(57) ABSTRACT

An ignition system for a light-duty combustion engine includes a charge winding, a microcontroller and a power supply sub-circuit. The sub-circuit is coupled to both the charge winding and the microcontroller and includes a first power supply switch, a power supply capacitor and a power supply zener. The sub-circuit is arranged to turn off the first power supply switch so that charging of the power supply capacitor stops when the charge on the power supply capacitor exceeds the breakdown voltage on the power supply zener. In at least some implementations, the power supply capacitor may power the microcontroller and the power supply sub-circuit may limit or reduce the amount of electrical energy taken from the induced AC voltage of the charge winding to a level that is still able to sufficiently power the microcontroller yet saves energy for use elsewhere in the system.

14 Claims, 3 Drawing Sheets

Related U.S. Application Data

(60) Provisional application No. 61/819,255, filed on May 3, 2013.

(51) Int. Cl.
*F02P 3/08* (2006.01)
*F02P 5/15* (2006.01)
*F02P 1/08* (2006.01)

(58) Field of Classification Search
USPC ..... 123/596, 601, 604, 605, 618, 634
See application file for complete search history.

(56) References Cited

U.S. PATENT DOCUMENTS

| | | | | |
|---|---|---|---|---|
| 5,392,753 | A * | 2/1995 | Burson | F02P 1/086 123/406.57 |
| 7,448,358 | B2 | 11/2008 | Andersson et al. | |
| 7,546,836 | B2 | 6/2009 | Andersson et al. | |
| 7,712,458 | B2 | 5/2010 | Olsson | |
| 2001/0037801 | A1 | 11/2001 | Ito et al. | |
| 2006/0065236 | A1 | 3/2006 | Andersson et al. | |
| 2007/0034190 | A1 | 2/2007 | Schieber et al. | |
| 2008/0178841 | A1 * | 7/2008 | Andersson | F02P 3/0815 123/406.57 |
| 2011/0041803 | A1 | 2/2011 | Qu et al. | |
| 2012/0291764 | A1 | 11/2012 | Sato et al. | |
| 2016/0076506 | A1 | 3/2016 | Andersson et al. | |

FOREIGN PATENT DOCUMENTS

| | | | |
|---|---|---|---|
| EP | 1277939 | A2 | 1/2003 |
| JP | H11153078 | A | 6/1999 |

OTHER PUBLICATIONS

CN Office Action for CN Application No. 201480025093.1 dated Sep. 26, 2016, 14 pages.
CN Office Action for CN Application No. 201480025093.1 dated Apr. 19, 2017, 13 pages.

* cited by examiner

IGNITION SYSTEM FOR LIGHT-DUTY COMBUSTION ENGINE

CROSS REFERENCE TO RELATED APPLICATIONS

This application is a continuation of U.S. Ser. No. 14/786,256 filed on Oct. 22, 2015 which is a national phase of PCT Serial No. PCT/US2014/036589 filed on May 2, 2014 and claims priority to U.S. Provisional Ser. No. 61/819,255 filed on May 3, 2013. The entire contents of these priority applications are incorporated herein by reference.

TECHNICAL FIELD

The present disclosure relates generally to internal combustion engines and, more particularly, to ignition systems for light-duty combustion engines.

BACKGROUND

Various ignition systems for light-duty combustion engines are known in the art and are used with a wide range of devices, such as lawn equipment and chainsaws. Typically, these ignition systems do not have a battery, instead they rely upon a pull-rope recoil starter and a magneto-type system to provide electrical energy for ignition and to operate other electrical devices. Because such systems can only produce a finite amount of electrical energy and still achieve certain energy efficiency and emissions goals, there is a need to generate and manage electrical energy in the system in as efficient a manner as possible.

SUMMARY

In at least some implementations, an ignition system for a light-duty combustion engine comprises: a charge winding that induces charge; an ignition discharge storage device that stores induced charge; an ignition discharge switch that discharges stored charge; a microcontroller that controls the ignition discharge switch; and a power supply sub-circuit that is coupled to both the charge winding and the microcontroller and provides power to the microcontroller. The power supply sub-circuit is configured to allow charging by the charge winding when the stored charge on the power supply sub-circuit is less than a threshold and to prevent charging by the charge winding when the stored charge on the power supply sub-circuit is greater than the threshold.

In at least some implementations, an ignition system for a light-duty combustion engine comprises: a charge winding that induces charge; an ignition discharge storage device that stores induced charge; an ignition discharge switch that discharges stored charge; a microcontroller that controls the ignition discharge switch; an additional device; and a power supply sub-circuit that is coupled to both the charge winding and the additional device and provides power to the additional device. The power supply sub-circuit is configured to allow charging by the charge winding when the stored charge on the power supply sub-circuit is less than a threshold and to prevent charging by the charge winding when the stored charge on the power supply sub-circuit is greater than the threshold.

In at least some implementations, a method for operating an ignition system for a light-duty combustion engine, comprising the steps of: charging an ignition discharge storage device with a charge winding; charging a power supply sub-circuit that powers a microcontroller with the charge winding when the stored charge on the power supply sub-circuit is less than a threshold; and preventing charging of the power supply sub-circuit with the charge winding when the stored charge on the power supply sub-circuit is greater than the threshold.

BRIEF DESCRIPTION OF THE DRAWINGS

The following detailed description of certain embodiments and best mode will be set forth with reference to the accompanying drawings, in which.

DETAILED DESCRIPTION

The methods and systems described herein generally relate to light-duty combustion engines that are gasoline powered and include microcontroller circuitry. As mentioned above, many light-duty combustion engines do not have a separate battery, instead, these engines use a magneto-type ignition system to generate, store and provide electrical energy to various devices. Because a magneto-type ignition system can only generate a finite amount of electrical energy at a certain engine speed, while still satisfying fuel efficiency and emission targets, it can be important for such a system to operate as efficiently as possible in terms of energy management. In the present case, the ignition system is designed to reduce the amount of electrical energy that is provided to and/or used by a certain power supply sub-circuit that powers a corresponding microcontroller so that additional electrical energy is available for other uses. More specifically, the ignition system determines when sufficient electrical energy has been received and/or stored at the power supply sub-circuit and, in response, ceases providing additional electrical energy to that sub-circuit so that the excess energy can be utilized by other devices around the engine.

Typically, the light-duty combustion engine is a single cylinder two-cycle or four-cycle gasoline powered internal combustion engine. A single piston is slidably received for reciprocation in the cylinder and is connected by a tie rod to a crank shaft that, in turn, is attached to a fly wheel. Such engines are oftentimes paired with a capacitive discharge ignition (CDI) system that utilizes a microcontroller to supply a high voltage ignition pulse to a spark plug for igniting an air-fuel mixture in the engine combustion chamber. The term "light-duty combustion engine" broadly includes all types of non-automotive combustion engines, including two-stroke and four-stroke engines typically used to power devices such as gasoline-powered hand-held power tools, lawn and garden equipment, lawnmowers, weed trimmers, edgers, chain saws, snowblowers, personal watercraft, boats, snowmobiles, motorcycles, all-terrain-vehicles, etc. It should be appreciated that while the following description is in the context of a capacitive discharge ignition (CDI) system, the control circuit and/or the power supply sub-circuit described herein may be used with any number of different ignition systems and are not limited to the particular one shown here.

Figure 1:
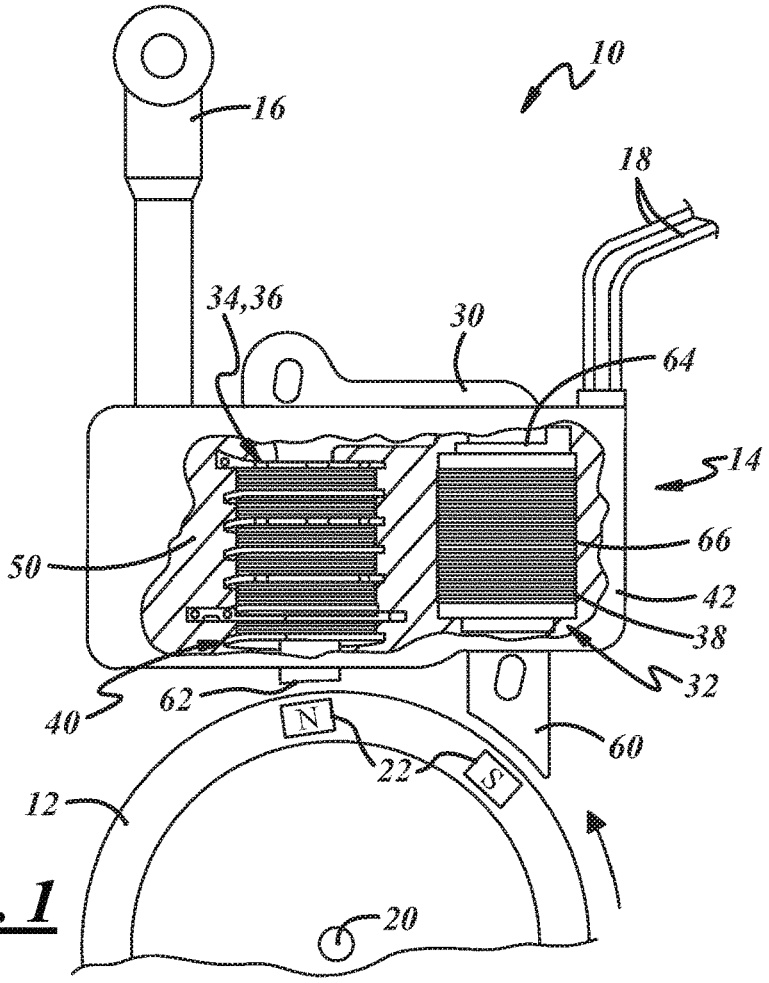
FIG. 1 shows an example of a capacitor discharge ignition (CDI) system for a light-duty combustion engine.

With reference to FIG. 1, there is shown a cut-away view of an exemplary capacitive discharge ignition (CDI) system 10 that interacts with a flywheel 12 and generally includes an ignition module 14, an ignition lead 16 for electrically coupling the ignition module to a spark plug SP (shown in FIG. 2), and electrical connections 18 for coupling the ignition module to one or more additional electric devices, such as a fuel controlling solenoid. Flywheel 12 is a weighted disk-like component that is coupled to a crankshaft 20 and thus rotates under the power of the engine. By using its rotational inertia, the flywheel moderates fluctuations in engine speed in order to provide a more constant and even output. The flywheel 12 shown here includes a pair of magnetic poles or elements 22 located towards an outer periphery of the flywheel. Once flywheel 12 is rotating, magnetic elements 22 spin past and electromagnetically interact with the different windings in ignition module 14, as is generally known in the art.

Ignition module 14 can generate, store, and utilize the electrical energy that is induced by the rotating magnetic elements 22 in order to perform a variety of functions. According to one embodiment, ignition module 14 includes a lamstack 30, a charge winding 32, a primary winding 34 and a secondary winding 36 that together constitute a step-up transformer, an additional winding 38, a trigger winding 40, an ignition module housing 42, and a control circuit 50. Lamstack 30 is preferably a ferromagnetic part that is comprised of a stack of flat, magnetically-permeable, laminate pieces typically made of steel or iron. The lamstack can assist in concentrating or focusing the changing magnetic flux created by the rotating magnetic elements 22 on the flywheel. According to the embodiment shown here, lamstack 30 has a generally U-shaped configuration that includes a pair of legs 60 and 62. Leg 60 is aligned along the central axis of charge winding 32, and leg 62 is aligned along the central axes of trigger winding 40 and the step-up transformer. The additional winding 38 is located on leg 60 and trigger winding 40 is shown on leg 62, however, these windings or coils could be located elsewhere on the lamstack 30. When legs 60 and 62 align with magnetic elements 22—this occurs at a specific rotational position of flywheel 12—a closed-loop flux path is created that includes lamstack 30 and magnetic elements 22. Magnetic elements 22 can be implemented as part of the same magnet or as separate magnetic components coupled together to provide a single flux path through flywheel 12, to cite two possibilities. Additional magnetic elements can be added to flywheel 12 at other locations around its periphery to provide additional electromagnetic interaction with ignition module 14.

Charge winding 32 generates electrical energy that can be used by ignition module 14 for a number of different purposes, including charging an ignition capacitor and powering an electronic processing device, to cite two examples. Charge winding 32 includes a bobbin 64 and a winding 66 and, according to one embodiment, is designed to have a relatively low inductance of about and a relatively low resistance, but this is not necessary. The electrical characteristics of a particular winding or coil are usually tailored to its specific application. For instance, a charge coil expected to produce high voltage will oftentimes have more turns of finer gauge wire (thus giving it a higher inductance and resistance) so that it can generate a sufficient voltage during startup or other periods of low engine speed. Conversely, a charge coil designed to provide high current will typically have less turns of larger gauge wire (with a corresponding lower inductance and resistance), as this enables it to more efficiently create high current when the engine is running at wide open throttle or during other high engine speed conditions. Any suitable type of charge winding known in the art may be used here.

Trigger winding 40 provides ignition module 14 with an engine input signal that is generally representative of the position and/or speed of the engine. According to the particular embodiment shown here, trigger winding 40 is located towards the end of lamstack leg 62 and is adjacent to the step-up transformer. It could, however, be arranged at a different location on the lamstack. For example, it is possible to arrange both the trigger and charge windings on a single leg of the lamstack, as opposed to arrangement shown here. It is also possible for trigger winding 40 to be omitted and for ignition module 14 to receive an engine input signal from charge winding 32 or some other device.

Step-up transformer uses a pair of closely-coupled windings 34, 36 to create high voltage ignition pulses that are sent to a spark plug SP via ignition lead 16. Like the charge and trigger windings described above, the primary and secondary windings 34, 36 surround one of the legs of lamstack 30, in this case leg 62. As with any step-up transformer, the primary winding 34 has fewer turns of wire than the secondary winding 36, which has more turns of finer gauge wire. The turn ratio between the primary and secondary windings, as well as other characteristics of the transformer, affect the high voltage and are typically selected based on the particular application in which it is used, as is appreciated by those skilled in the art.

Ignition module housing 42 is preferably made from a rigid plastic, metal, or some other material, and is designed to surround and protect the components of ignition module 14. The ignition module housing 42 has several openings that allow lamstack legs 60 and 62, ignition lead 16, and electrical connections 18 to protrude, and preferably are sealed so that moisture and other contaminants are prevented from damaging the ignition module. It should be appreciated that ignition system 10 is just one example of a capacitive discharge ignition (CDI) system that can utilize ignition module 14, and that numerous other ignition systems and components, in addition to those shown here, could also be used as well.

In at least some implementations, control circuit 50 is housed within the housing 42 and is coupled to portions of the ignition module 14 and the spark plug SP so that it can control the energy that is induced, stored and discharged by the ignition system 10. The term "coupled" broadly encompasses all ways in which two or more electrical components, devices, circuits, etc. can be in electrical communication with one another; this includes but is certainly not limited to, a direct electrical connection and a connection via intermediate components, devices, circuits, etc. The control circuit 50 may be provided according to the exemplary embodiment shown in FIG. 2 where the control circuit is coupled to and interacts with charge winding 32, primary ignition winding 34, additional winding 38, and trigger winding 40. According to this particular example, the control circuit 50 includes an ignition discharge capacitor 52, an ignition discharge switch 54, a microcontroller 56, a power supply sub-circuit 58, as well as any number of other electrical elements, components, devices and/or sub-circuits that may be used with the control circuit and are known in the art (e.g., kill switches and kill switch circuitry).

The ignition discharge capacitor 52 acts as a main energy storage device for the ignition system 10. According to the embodiment shown in FIG. 2, the ignition discharge storage device or simply the ignition discharge capacitor 52 is coupled to the charge winding 32 and the ignition discharge switch 54 at a first terminal, and is coupled to the primary winding 34 at a second terminal. The ignition discharge capacitor 52 is configured to receive and store electrical energy from the charge winding 32 via diode 70 and to discharge the stored electrical energy through a path that includes the ignition discharge switch 54 and the primary winding 34. Discharge of the electrical energy stored on the ignition discharge capacitor 52 is controlled by the state of the ignition discharge switch 54, as is widely understood in the art.

The ignition discharge switch 54 acts as a main switching device for the ignition system 10. The ignition discharge switch 54 is coupled to the ignition discharge capacitor 52 at a first current carrying terminal, to ground at a second current carrying terminal, and to an output of the microcontroller 56 at its gate. The ignition discharge switch 54 can be provided as a thyristor, for example, a silicon controller rectifier (SCR). An ignition trigger signal from an output of the microcontroller 56 activates the ignition discharge switch 54 so that the ignition discharge capacitor 52 can discharge its stored energy through the switch and thereby create a corresponding ignition pulse in the ignition coil.

The microcontroller 56 is an electronic processing device that executes electronic instructions in order to carry out functions pertaining to the operation of the light-duty combustion engine. This may include, for example, electronic instructions used to implement the methods described herein. In one example, the microcontroller 56 includes the 8-pin processor illustrated in FIG. 2, however, any other suitable controller, microcontroller, microprocessor and/or other electronic processing device may be used instead. Pins 1 and 8 are coupled to the power supply sub-circuit 58, which provides the microcontroller with power that is somewhat regulated; pins 2 and 7 are coupled to trigger winding 40 and provide the microcontroller with an engine signal that is representative of the speed and/or position of the engine (e.g., position relative to top-dead-center); pins 3 and 5 are shown as being unconnected, but may be coupled to other components like a kill-switch; pin 4 is coupled to ground; and pin 6 is coupled to the gate of ignition discharge switch 54 so that the microcontroller can provide an ignition trigger signal, sometimes called a timing signal, for activating the switch. Several non-limiting examples of how microcontrollers can be implemented with ignition systems are provided in U.S. Pat. Nos. 7,546,836 and 7,448,358, the entire contents of which are hereby incorporated by reference.

The power supply sub-circuit 58 receives electrical energy from the charge winding 32, stores the electrical energy, and may provide the microcontroller 56 with regulated, or at least somewhat regulated, electrical power. The power supply sub-circuit 58 is coupled to the charge winding 32 at an input terminal 80 and to the microcontroller 56 at an output terminal 82 and, according to the example shown in FIG. 2, includes a first power supply switch 90, a power supply capacitor 92, a power supply zener 94, a second power supply switch 96, and one or more power supply resistors 98. As will be explained below in more detail, the power supply sub-circuit 58 is designed and configured to reduce the portion of the charge winding load that is attributable to powering the microcontroller 56 which, in turn, allows more electrical energy to flow to other devices, such as those powered by the additional winding 38.

The first power supply switch 90, which can be any suitable type of switching device like a BJT or MOSFET, is coupled to the charge winding 32 at a first current carrying terminal, to the power supply capacitor 92 at a second current carrying terminal, and to the second power supply switch 96 at a base or gate terminal. When the first power supply switch 90 is activated or is in an 'on' state, current is allowed to flow from the charge winding 32 to the power supply capacitor 92; when the switch 90 is deactivated or is in an 'off' state, current is prevented from flowing from the charge winding 32 to the capacitor 92. As mentioned above, any suitable type of switching device may be used for the first power supply switch 90, and the device may be designed to handle a significant amount of voltage in at least some implementations, for example between about 150 V and 450 V.

The power supply storage device or simply the power supply capacitor 92 is coupled to the first power supply switch 90, the power supply zener 94 and the microcontroller 56 at a positive terminal, and is coupled to ground at a negative terminal. The power supply capacitor 92 receives and stores electrical energy from the charge winding 32 so that it may power the microcontroller 56 in a somewhat regulated and consistent manner. Skilled artisans will appreciate that the operating parameters of the power supply capacitor 92 are generally dictated by the needs of the specific control circuit in which it is being used, however, in one example, the power supply capacitor has a capacitance between about 50 μF and 470 μF.

The power supply zener 94 is coupled to the power supply capacitor 92 at a cathode terminal and is coupled to second power supply switch 96 at an anode terminal. The power supply zener 94 is arranged to be non-conductive in a reverse direction (i.e., non-conductive from the cathode to the anode of the zener) when the voltage on the power supply capacitor 92 is less than the breakdown voltage of the zener diode and to be conductive in the reverse direction (i.e., conductive from the cathode to the anode) when the capacitor voltage exceeds the breakdown voltage. Skilled artisans will appreciate that a zener diode with a particular breakdown voltage may be selected based on the amount of electrical energy that is deemed necessary for the power supply sub-circuit 58 to properly power the microcontroller 56. Any zener diode or other similar device may be used, including but not limited to zener diodes having a breakdown voltage between about 3 V and 20 V.

The second power supply switch 96 is coupled to resistor 98 and the base of the first power supply switch 90 at a first current carrying terminal, to ground at a second current carrying terminal, and to the power supply zener diode 94 at a gate. As will be described below in more detail, the second power supply switch 96 is arranged so that when the voltage at the zener diode 94 is less than its breakdown voltage, the second power supply switch 96 is held in a deactivated or 'off' state; when the voltage at the zener diode exceeds the breakdown voltage, then the voltage at the gate of the second power supply switch 96 increases and activates that device so that it turns 'on'. Again, any number of different types of switching devices may be used, including thyristors in the form of silicon controller rectifiers (SCRs). According to one non-limiting example, the second power supply switch is an SCR and has a gate current rate between about 2 μA and 3 mA.

The power supply resistor 98 is coupled at one terminal to charge winding 32 and one of the current carrying terminals of the first power supply switch 90, and at another terminal to one of the current carrying terminals of the second power supply switch 96. It is preferable that power supply resistor 98 have a sufficiently high resistance so that a high-resistance, low-current path is established through the resistor when the second power supply switch 96 is turned 'on'. In one example, the power supply resistor 98 has a resistance between about 5 kΩ and 10 kΩ, however, other values may certainly be used instead.

During a charging cycle, electrical energy induced in the charge winding 32 may be used to charge, drive and/or otherwise power one or more devices around the engine. For example, as the flywheel 12 rotates past the ignition module 14, the magnetic elements 22 located towards the outer perimeter of the flywheel induce an AC voltage in the charge winding 32. A positive component of the AC voltage may be used to charge the ignition discharge capacitor 52, while a negative component of the AC voltage may be provided to the power supply sub-circuit 58 which then powers the microcontroller 56 with regulated DC power. The power supply sub-circuit 58 is designed to limit or reduce the amount of electrical energy taken from the negative component of the AC voltage to a level that is still able to sufficiently power the microcontroller 56, yet saves energy for use elsewhere in the system. One example of a device that may benefit from this energy savings is a solenoid that is coupled to the addition winding 38 and is used to control the air/fuel ratio being provided to the combustion chamber.

Beginning with the positive component or portion of the AC voltage that is induced in the charge winding 32, current flows through diode 70 and charges ignition discharge capacitor 52. So long as the microcontroller 56 holds the ignition discharge switch 54 in an 'off' state, the current from the charge winding 32 is directed to the ignition discharge capacitor 52. It is possible for the ignition discharge capacitor 52 to be charged throughout the entire positive portion of the AC voltage waveform, or at least for most of it. When it is time for the ignition system 10 to fire the spark plug SP (i.e., the ignition timing), the microcontroller 56 sends an ignition trigger signal to the ignition discharge switch 54 that turns the switch 'on' and creates a current path that includes the ignition discharge capacitor 52 and the primary ignition winding 34. The electrical energy stored on the ignition discharge capacitor 52 rapidly discharges via the current path, which causes a surge in current through the primary ignition winding 34 and creates a fast-rising electro-magnetic field in the ignition coil. The fast-rising electro-magnetic field induces a high voltage ignition pulse in the secondary ignition winding 36 that travels to the spark plug SP and provides a combustion-initiating spark. Other sparking techniques, including fly-back techniques, may be used instead.

Turning now to the negative component or portion of the AC voltage that is induced in the charge winding 32, current initially flows through the first power supply switch 90 and charges power supply capacitor 92. So long as second power supply switch 96 is turned 'off', there is some current flow through power supply resistor 98 and into the base of power supply switch 90 (current not being diverted through switch 96) so that the voltage at the base of the first power supply switch 90 biases the switch in an 'on' state. Charging of the power supply capacitor 92 continues until a certain charge threshold is met; that is, until the accumulated charge on capacitor 92 exceeds the breakdown voltage of the power supply zener 94. As mentioned above, zener diode 94 is preferably selected to have a certain breakdown voltage that corresponds to a desired charge level for the power supply sub-circuit 58. Some initial testing has indicated that a breakdown voltage of approximately 6 V may be suitable. The power supply capacitor 92 uses the accumulated charge to provide the microcontroller 56 with regulated DC power. Of course, additional circuitry like the secondary stage circuitry 86 may be employed for reducing ripples and/or further filtering, smoothing and/or otherwise regulating the DC power.

Once the stored charge on the power supply capacitor 92 exceeds the breakdown voltage of the power supply zener 94, the zener diode becomes conductive in the reverse bias direction so that the current seen at the gate of the second power supply switch 96 increases. This turns the second power supply switch 96 'on', which creates a low current path 84 that flows through resistor 98 and switch 96 and lowers the voltage at the base of the first power supply switch 90 to a point where it turns that switch 'off'. With first power supply switch 90 deactivated or in an 'off' state, additional charging of the power supply capacitor 92 is prevented. Moreover, power supply resistor 98 preferably exhibits a relatively high resistance so that the amount of current that flows through the low current path 84 during this period of the negative portion of the AC cycle is minimal (e.g., on the order of 50 μA) and, thus, limits the amount of wasted electrical energy. The first power supply switch 90 will remain 'off' until the microcontroller 56 pulls enough electrical energy from power supply capacitor 92 to drop its voltage below the breakdown voltage of the power supply zener 94, at which time the second power supply switch 96 turns 'off' so that the cycle can repeat itself. This arrangement may somewhat simulate a low cost hysteresis approach.

Accordingly, instead of charging the power supply capacitor 92 during the entire negative portion of the AC voltage waveform, the power supply sub-circuit 58 only charges capacitor 92 for a first segment of the negative portion of the AC voltage waveform; during a second segment, the capacitor 92 is not being charged. Put differently, the power supply sub-circuit 58 only charges the power supply capacitor 92 until a certain charge threshold is reached, after which additional charging of capacitor 92 is cut off. Because less electrical current is flowing from the charge winding 32 to the power supply sub-circuit 58, the electromagnetic load on the winding and/or the circuit is reduced, thereby making more electrical energy available for other windings and/or other devices. If the electrical energy in the ignition system 10 is managed efficiently, it may possible for the system to support both an ignition load and external loads (e.g., an air/fuel ratio regulating solenoid) on the same magnetic circuit.

Skilled artisans will appreciate that this arrangement and approach is somewhat different than simply utilizing a simple current limiting circuit to clip the amount of current that is allowed into the power supply sub-circuit 58 at any given time. Such an approach may result in undesirable effects, in that it may be slow to reach a working voltage due to the limited current available, thus, causing unwanted delays in the functionality of the ignition system. The power supply sub-circuit 58 is designed to allow higher amounts of current to quickly flow into the power supply capacitor 92, which charges the power supply more rapidly and brings it to a sufficient DC operating level in a shorter amount of time than is experienced with a simple current limiting circuit.

Figure 3:
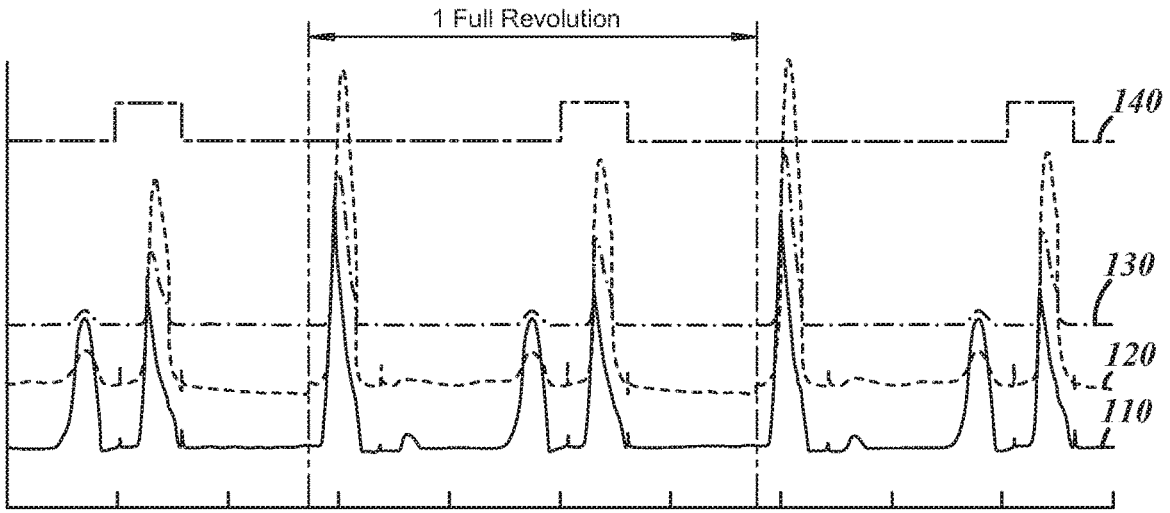
(Prior Art) FIG. 3
FIGS. 3-6 are graphs that plot the voltage, current and power provided to a power supply sub-circuit that can be used with the control circuit of FIG. 2, where FIGS. 3 and 4 correspond to a prior art power supply sub-circuit and FIGS. 5 and 6 correspond to the power supply sub-circuit described herein.
Figure 5:
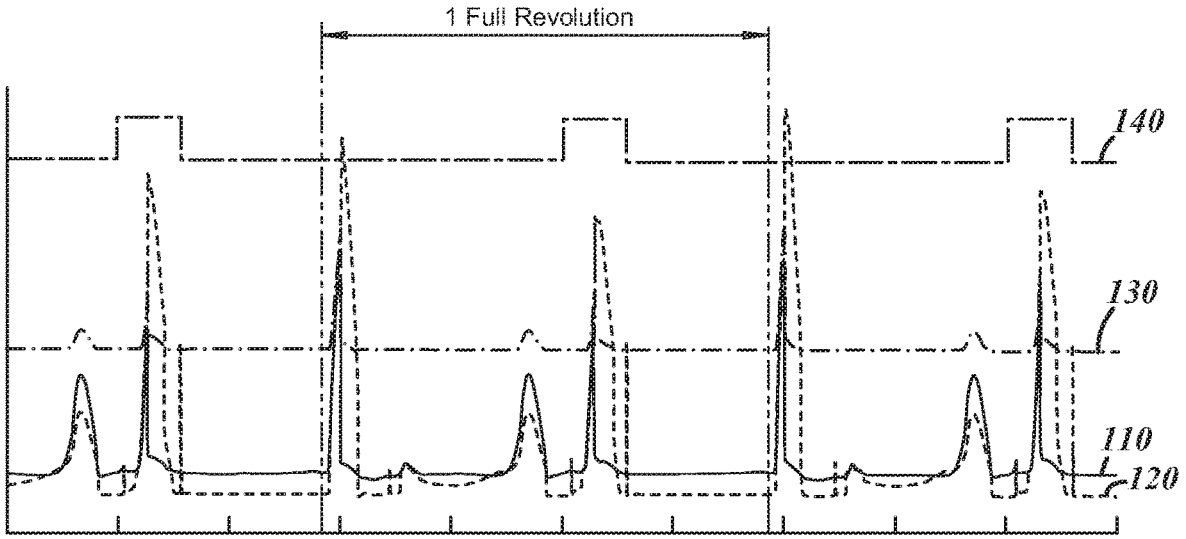
Figure 4:
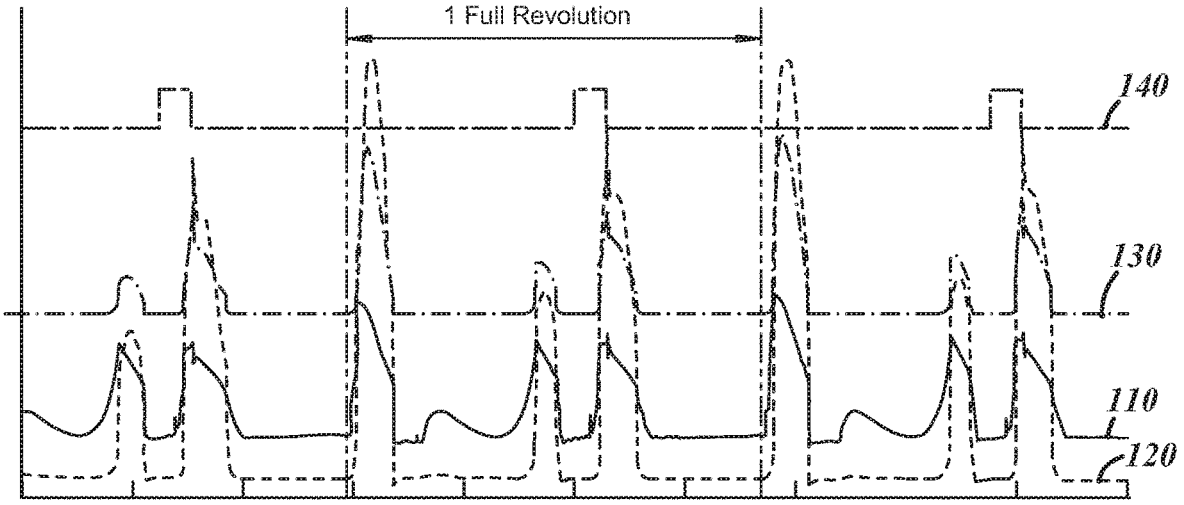
(Prior Art) FIG. 4
Figure 6:
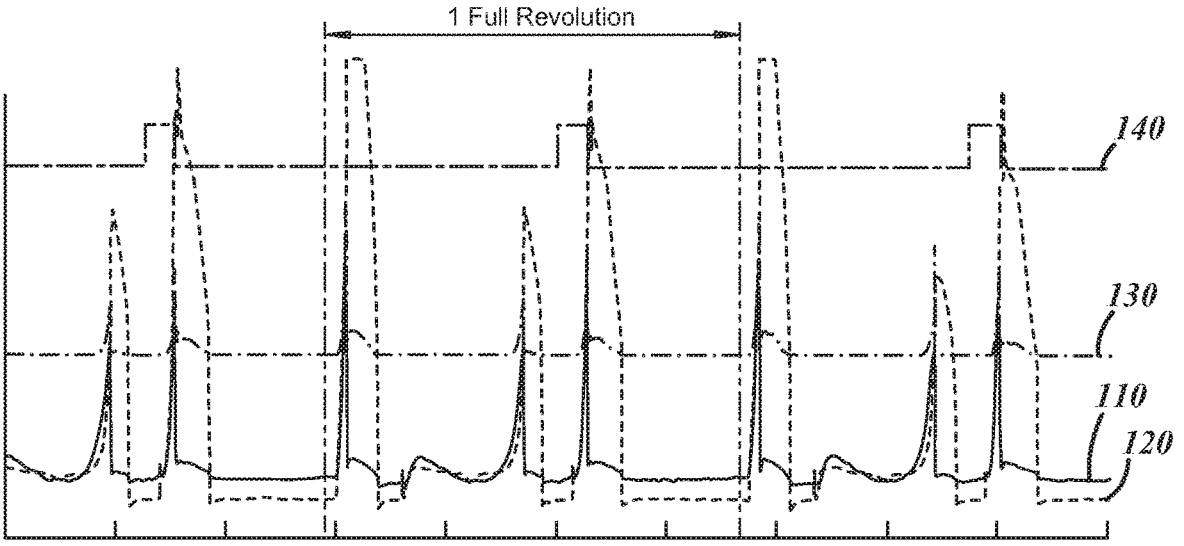

Some of the potential advantages of the ignition system 10 described above can be observed from the graphs shown in FIGS. 3-6. The graphs in FIGS. 3 and 4 show a previous ignition system with a power supply sub-circuit operating at an idle speed of about 3,000 rpm and a wide-open-throttle (WOT) speed of about 8,000 rpm, respectively. FIGS. 5 and 6 show the present ignition system with power supply sub-circuit 58 operating at an idle speed of about 3,000 rpm and at a wide-open-throttle (WOT) speed of about 8,000 rpm, respectively. In each of the graphs, plot 110 represents the current into the power supply sub-circuit as a function of time; plot 120 represents the voltage into the power supply sub-circuit as a function of time; plot 130 is representative of the overall power into the power supply sub-circuit as a function of time; and plot 140 is a timing reference signal that shows revolutions of the engine as a function of time. As illustrated by the graphs, the average amount of power into the power supply sub-circuit of the previous ignition system is about 0.69 W across one revolution at idle and about 1.45 W at wide-open-throttle. In comparison, the average amount of power into the power supply sub-circuit of the present ignition system is about 0.25 W across one revolution at idle and about 0.35 W at wide-open-throttle. This translates into an energy savings of more than about 60% at idle and more than about 70% at WOT, in terms of average electrical power used by the power supply sub-circuit. In addition to conserving electrical energy, the ignition system 10 may be able to utilize electrical components having lower power specifications. This typically results in a corresponding cost savings.

As mentioned above, the electrical energy that is saved or not used by power supply sub-circuit 58 may be applied to any number of different devices around the engine. One example of such a device is a solenoid that controls the air/fuel ratio of the gas mixture supplied from a carburetor to a combustion chamber. Referring back to FIG. 2, the additional winding 38 could be coupled to a device 88, such as a solenoid, an additional microcontroller or any other device requiring electrical energy. During a first segment of the negative AC voltage waveform, the charge winding 32 powers sub-circuit 58 at the same time that the additional winding 38 powers device 88; during a second segment, however, only the additional winding 38 has to power device 88, as the power supply capacitor 92 has been turned off so that the sub-circuit 58 only draws minimal power. There is less magnetic load on the charge winding 32 during the second segment and therefore there is more electrical energy available to power device 88. The transition point between the first and second segments of the negative AC voltage may occur when the charge on the power supply capacitor 92 exceeds the breakdown voltage of power supply zener 94. At this point, capacitor 92 is no longer being charged.

At very low engine speeds (e.g., between about 1,000-1,500 rpm), the solenoid or other device 88 is typically not activated and, thus, does not require much energy. At higher engine speeds, the power supply sub-circuit 58 may have enough stored energy that first power supply switch 90 only turns 'on' for short periods of time every couple of engine revolutions. In this case, the excess energy, which previously was wasted, can be coupled into additional winding 38 to power solenoid 88 or some other device. One potential consequence of this arrangement is that more electrical power may be routed to external devices like solenoid 88, thereby allowing them to be controlled at even lower engine speeds.

Figure 2:
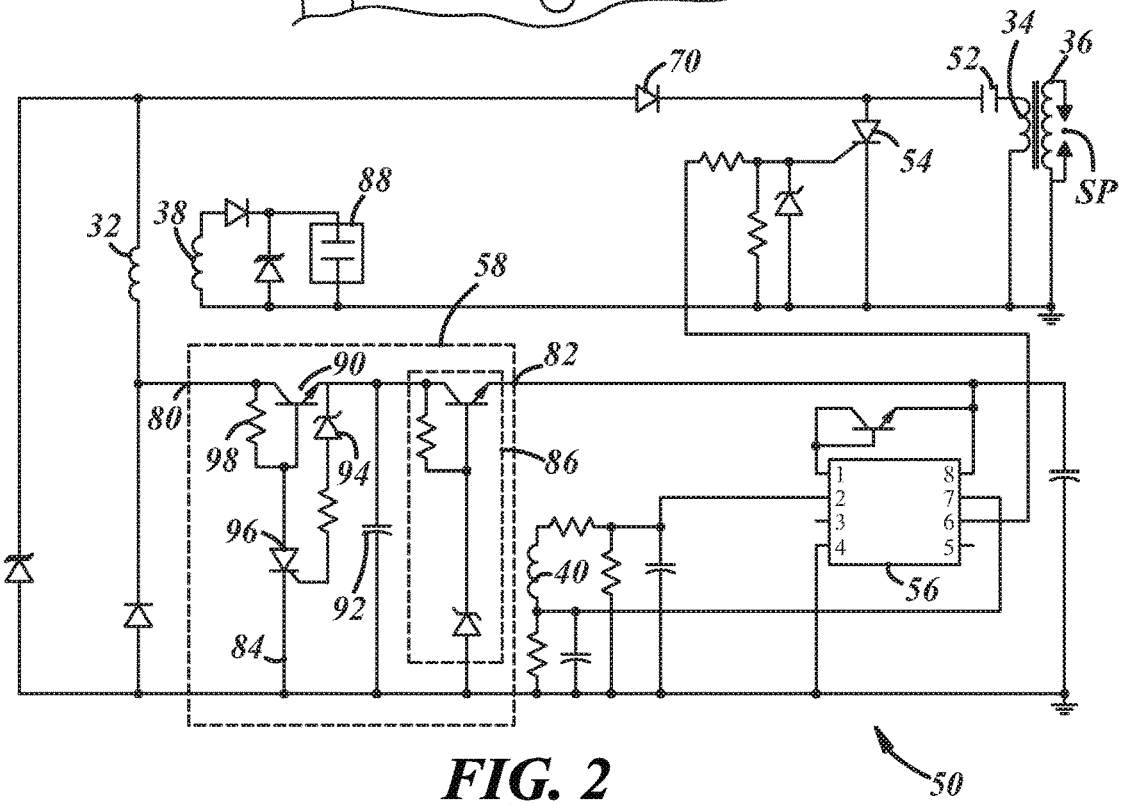
FIG. 2 is a schematic diagram of a control circuit that may be used with the CDI system of FIG. 1.

It should be appreciated that the ignition system 10 described in the preceding paragraphs and illustrated in the circuit schematic of FIG. 2, including power supply sub-circuit 58, is only one example of how such a system could be implemented. It is certainly possible to implement this ignition system and/or power supply sub-circuit using a different combination or arrangement of electrical components or elements. The ignition system and/or power supply sub-circuit are not limited to the exact embodiments disclosed herein, as they are simply provided as illustrative examples. For example, it is possible for the power supply sub-circuit 58 to be coupled to the additional winding 38 and for the additional device 88 to be coupled to the charge winding 32, or it is possible for both the power supply sub-circuit 58 and the additional winding 32 to be coupled to the same winding, instead of the arrangement shown in FIG. 2. Another possibility is for the power supply sub-circuit to be coupled to and to power some additional device other than the microcontroller, such as a solenoid or the like. Other examples are possible as well.

While the forms of the invention herein disclosed constitute presently preferred embodiments, many others are possible. It is not intended herein to mention all the possible equivalent forms or ramifications of the invention. It is understood that the terms used herein are merely descriptive, rather than limiting, and that various changes may be made without departing from the spirit or scope of the invention.

The invention claimed is:

1. A method for operating an ignition system for a light-duty combustion engine, comprising the steps of:

charging an ignition discharge storage device with a charge winding;

charging a power supply capacitor of a power supply sub-circuit that powers a microcontroller with the charge winding through a first power supply switch when the stored charge on the power supply capacitor is less than a threshold;

by the first power supply switch preventing charging of the power supply sub-circuit by the charge winding when the stored charge on the power supply capacitor is greater than the threshold;

charging the power supply capacitor until the stored charge exceeds a breakdown voltage of a zener diode where the breakdown voltage corresponds to the threshold, and, in response to the stored charge exceeding the breakdown voltage, changing the state of the first power supply switch to prevent charging of the power supply capacitor of the sub-circuit; and turning 'on' a second power supply switch of the power supply sub-circuit when the stored charge exceeds the breakdown voltage of the zener diode and, in response to the second power supply switch being turned 'on', turning 'off' the first power supply switch and preventing charging of the power supply sub-circuit.

2. The method of claim 1, wherein the ignition discharge storage device is coupled to a first terminal of the charge winding and the power supply sub-circuit is coupled to a second terminal of the charge winding, and the method further comprises charging the ignition discharge storage device with the charge winding during either a positive or negative portion of an AC voltage waveform and charging the power supply sub-circuit with the charge winding during the other of the positive or negative portion of the AC voltage waveform.

3. The method of claim 1, wherein the method further comprises reducing the average amount of electrical power consumed by the power supply sub-circuit by preventing charging of the power supply sub-circuit when the stored charge on the power supply sub-circuit is greater than the threshold.

4. The method of claim 1, wherein the method further comprises charging the power supply sub-circuit with the charge winding and powering an additional device with an additional charge winding during a first segment of an AC voltage waveform, and only powering the additional device with the additional charge winding without charging the power supply sub-circuit with the charge winding during a second segment of the AC voltage waveform.

5. A method for operating an ignition system for a light-duty combustion engine, comprising the steps of:

charging an ignition discharge storage device with a charge winding;

charging a power supply capacitor of a power supply sub-circuit that powers a microcontroller with the charge winding through a power supply switch when the stored charge on the power supply capacitor is less than a threshold;

by the power supply switch preventing charging of the power supply sub-circuit by the charge winding when the stored charge on the power supply capacitor is greater than the threshold, wherein the ignition system further comprises a primary ignition winding, a secondary ignition winding, an additional winding and an additional device coupled to the additional winding, and the method further comprises discharging the ignition discharge storage device to a primary ignition winding, inducing a high voltage ignition pulse in a secondary ignition winding with the primary ignition winding for powering a spark plug, and powering the additional device with charge induced in the additional winding.

6. The method of claim 5, wherein the additional device is a solenoid that controls an air/fuel ratio provided to the light-duty combustion engine.

7. The method of claim 5, wherein the power supply sub-circuit further comprises a zener diode with a breakdown voltage that corresponds to the threshold, and the method further comprises charging the power supply capacitor until the stored charge exceeds the breakdown voltage of the zener diode and, in response to the stored charge exceeding the breakdown voltage, changing the state of the power supply switch to prevent charging of the power supply capacitor of the sub-circuit.

8. The method of claim 7, wherein the power supply sub-circuit further comprises a second power supply switch, and the method further comprises turning 'on' the second power supply switch when the stored charge exceeds the breakdown voltage of the zener diode and, in response to the second power supply switch being turned 'on', turning 'off' the power supply switch and preventing charging of the power supply sub-circuit.

9. The method of claim 5, wherein the method further comprises reducing the average amount of electrical power consumed by the power supply sub-circuit by preventing charging of the power supply sub-circuit when the stored charge on the power supply sub-circuit is greater than the threshold.

10. The method of claim 5, wherein the method further comprises charging the power supply sub-circuit with the charge winding and powering the additional device with the additional charge winding during a first segment of an AC voltage waveform, and only powering the additional device with the additional charge winding without charging the power supply sub-circuit with the charge winding during a second segment of the AC voltage waveform.

11. A method for operating an ignition system for a light-duty combustion engine, comprising the steps of:

charging an ignition discharge storage device with a charge winding;

charging a power supply capacitor of a power supply sub-circuit that powers a microcontroller with the charge winding through a power supply switch when the stored charge on the power supply capacitor is less than a threshold;

by the power supply switch preventing charging of the power supply sub-circuit by the charge winding when the stored charge on the power supply capacitor is greater than the threshold;

charging the power supply sub-circuit with the charge winding and powering an additional device with an additional charge winding during a first segment of an AC voltage waveform, and only powering the additional device with the additional charge winding without charging the power supply sub-circuit with the charge winding during a second segment of the AC voltage waveform; and discharging the ignition discharge storage device to a primary ignition winding, inducing a high voltage ignition pulse in a secondary ignition winding with the primary ignition winding for powering a spark plug, where the additional charge winding is not the primary ignition winding, the secondary ignition winding or the charge winding by which the ignition discharge storage device is charged.

12. The method of claim 11, wherein the power supply sub-circuit comprises a power supply switch and a power supply capacitor, and the method further comprises charging the power supply capacitor through the power supply switch with the charge winding.

13. The method of claim 12, wherein the power supply sub-circuit further comprises a zener diode with a breakdown voltage that corresponds to the threshold, and the method further comprises charging the power supply capacitor until the stored charge exceeds the breakdown voltage of the zener diode and, in response to the stored charge exceeding the breakdown voltage, changing the state of the power supply switch to prevent charging of the power supply capacitor of the sub-circuit.

14. The method of claim 11 wherein the method further comprises reducing the average amount of electrical power consumed by the power supply sub-circuit by preventing charging of the power supply sub-circuit when the stored charge on the power supply sub-circuit is greater than the threshold.

* * * * *